US005394079A

United States Patent [19]

Llewellyn

[11] Patent Number: 5,394,079

[45] Date of Patent: Feb. 28, 1995

[54] CURRENT MIRROR WITH IMPROVED INPUT VOLTAGE HEADROOM

[75] Inventor: William D. Llewellyn, San Jose, Calif.

[73] Assignee: National Semiconductor Corporation, Santa Clara, Calif.

[21] Appl. No.: 53,627

[22] Filed: Apr. 27, 1993

[51] Int. Cl.[6] ..... G05F 3/16; G05F 3/20

[52] U.S. Cl. ..... 323/315; 323/316

[58] Field of Search ..... 323/315, 316, 317

[56] References Cited

U.S. PATENT DOCUMENTS

| | | | |
|---|---|---|---|
| 4,008,441 | 2/1977 | Schade, Jr. | 323/315 X |
| 4,525,682 | 6/1985 | Lai et al. | 323/315 X |
| 4,808,847 | 2/1989 | Van Kessel | 323/315 X |
| 4,937,515 | 6/1990 | Yoshino | 323/315 |

OTHER PUBLICATIONS

National Semiconductor Paper entitled "LM105/LM205/LM305/LM305A, LM376 Voltage Regulators", National Semiconductor Corp., Santa Clara, Calif., (Apr. 1993).

Advances in BiMOS Integrated Circuits, Schade, Jr., RCA Review, vol. 30, Jun. 1978.

*Primary Examiner*—R. Skudy
*Assistant Examiner*—E. To
*Attorney, Agent, or Firm*—Steven F. Caserza

[57] ABSTRACT

A novel current mirror is taught which provides improved input voltage headroom. The current mirror provides for the ratioed current mirroring of an input current supplied by a current source while providing an increased voltage level to that current source as compared with prior art current mirrors. This provides a significant improvement over prior art current mirrors which are likely to provide an insufficiently high voltage level to the current source to allow its proper operation, particularly with the trend toward lower supply voltages.

25 Claims, 2 Drawing Sheets

CURRENT MIRROR WITH IMPROVED INPUT VOLTAGE HEADROOM

BACKGROUND

This invention pertains to electronic circuits and more particularly to current mirror circuits suitable for use at low power supply voltages. More specifically, this invention pertains to current mirrors suitable for use at power supply voltages below 3 volts while avoiding the need for complex circuit design techniques and the attendant limitations previously required with respect to the circuits providing the current to be mirrored.

DESCRIPTION OF PRIOR ART

There is a significant desire to create electronic circuits capable of operating at lower supply voltage ranges than in the recent past. Currently, a large number of integrated circuits are available which operate from a standard 5 volt supply. The present trend is to provide integrated circuits capable of operating at lower supply voltages, for example a nominal 3 volt supply which may have a valid voltage level of as low as 2.7 volts. While the users of such integrated circuits are clamoring for the reduced supply voltage devices because of the benefits available to the user with these devices, the need to create integrated circuits which will operate with such low supply voltages provides significant challenges to integrated circuit designers.

For example, a conventional P channel MOS current mirror 10 is shown in the schematic diagram of FIG. 1. Prior art current mirror 10 includes $V_{CC}$ supply voltage terminal 14, a negative supply voltage terminal 15, where $V_{CC}$ is typically 5 volts and the negative supply voltage is typically 0 volts (ground). Current mirror 10 includes diode-connected P channel transistor 12 serving as an input device having its source connected to $V_{CC}$ terminal 14, and its commonly connected gate and drain connected to receive input current $I_{IN}$ from current source 11. In practice, current source 11 is likely to be fabricated of additional circuitry contained on the same integrated circuit as is current mirror 10. Current $I_{IN}$ is forced to flow through diode-connected P channel transistor 12, and this current is mirrored through P channel transistor 13, having its source connected in common with the source of transistor 12 to $V_{CC}$ supply terminal 14 and its gate connected to the gate of P channel transistor 12. Thus, a current $I_{IN}$ is mirrored through output transistor 13 to load 16. If desired, the sizes of transistors 12 and 13 can be ratioed so that the current mirrored by output transistor 13 can be any desired fraction less than or greater than $I_{IN}$.

The voltage on the drain of transistor 12 which is connected to current source 11 is equal to $$V_1 = V_{CC} - (V_{TP} + V_{GO}) \quad (1)$$

where

- $V_{CC}$ = the supply voltage applied to positive supply terminal 14 (with supply voltage terminal 15 being connected to ground);
- $V_{TP}$ = the threshold voltage of P channel transistor 12 (typically 1 volt); and
- $V_{GO}$ = the overdrive voltage necessary to be applied to the gate of P channel transistor 12 in order to establish current flow through the channel of P channel transistor 12 (typically 0.2 to 0.8 volts).

Thus, $V_{TP} + V_{GO}$ is typically between approximately 1.2 and 1.8 volts, depending on the current flow through transistor 12, the size of transistor 12, and the operating temperature of the circuit.

In a typical prior art system where $V_{CC}$ is approximately 5 volts, $V_1$ is within the range of approximately 3.2 to 3.8 volts, which is sufficiently high to allow easy design and fabrication of circuitry within the integrated circuit to serve as input current source 11. However, in keeping with the desire to provide integrated circuits capable of operating at lower voltages, for example where $V_{CC}$ equals 3 volts, $V_1$ would range from approximately 1.2 volts to 1.8 volts. Given the fact that in a nominal 3 volt supply a 10% deviation is acceptable, meaning a legitimate $V_{CC}$ might be as low as 2.7 volts, $V_1$ would range from approximately 0.9 to 1.5 volts. This low voltage available as voltage $V_1$ in a prior art current mirror 10 operating at a low $V_{CC}$ voltage of 2.7 to 3.0 volts is in many circumstances insufficient to allow design and/or proper operation of circuitry serving as current source 11.

Accordingly, there are limitations in the circumstances in which prior art current mirror 10 may be used in low voltage devices.

SUMMARY

In accordance with the teachings of this invention, a novel current mirror is taught which provides improved input voltage headroom. Thus, the current mirror of this invention provides for the ratioed current mirroring of an input current supplied by a current source while providing an increased voltage level to that current source as compared with prior art current mirrors. This provides a significant improvement over prior art current mirrors which are likely to provide an insufficiently high voltage level to the current source to allow its proper operation.

DETAILED DESCRIPTION

Figure 1:
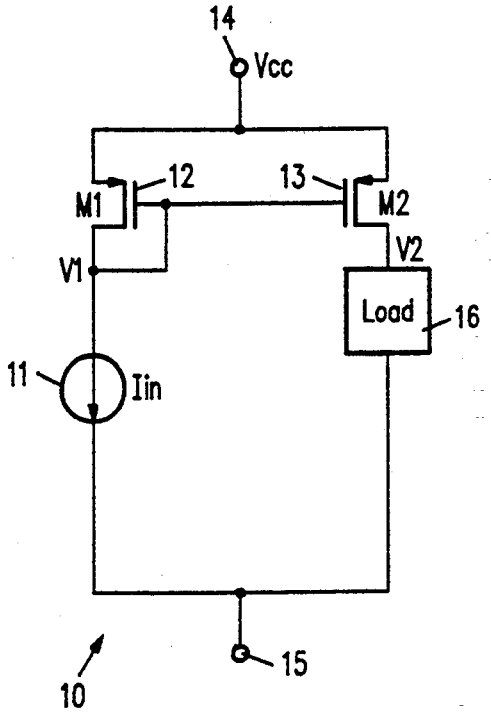
PRIOR ART FIG. 1
FIG. 1 is a schematic diagram of a typical prior art P channel MOS current mirror.
Figure 2:
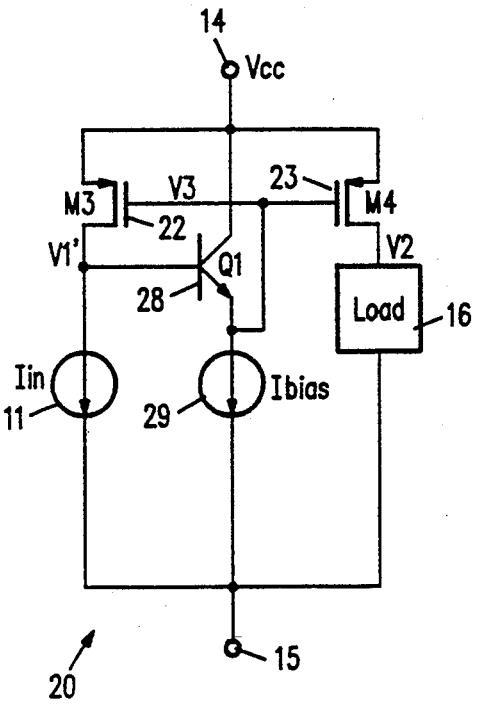
FIG. 2 is a schematic diagram of one embodiment of a P channel current mirror constructed in accordance with the teachings of this invention, which utilizes a bipolar transistor for level shifting.

FIG. 2 is a schematic diagram of one embodiment of a novel current mirror constructed in accordance with the teachings of this invention. Current mirror 20 includes $V_{CC}$ supply voltage terminal 14, and supply voltage terminal 15 which is typically connected to ground. Current mirror 20 receives an input current $I_{IN}$ from current source 11 and provides a mirrored and, if desired, ratioed output current to load 16. Input current $I_{IN}$ is applied to the drain of P channel transistor 22, which has its source connected to $V_{CC}$ terminal 14. The gates of transistors 22 and 23 are connected in common, the source of transistor 23 is connected to $V_{CC}$ terminal 14, and its drain is connected to provide output current to load device 16.

In accordance with the teachings of this invention, bipolar transistor 28 is used to provide an increased voltage to current source 11 as compared with prior art current mirrors. Bipolar transistor 28 has its collector connected to $V_{CC}$ supply terminal 14, its base connected to the drain of transistor 22 and thus to current source 11, and its emitter connected to the commonly connected gates of transistors 22 and 23. A bias current source 29 draws bias current $I_{BIAS}$ through bipolar transistor 28 to ground.

In accordance with the teachings of this invention, novel current mirror 20 provides a voltage to current source 11:

$$V'_1 = V_{CC} - (v_{TP} + V_{GO}) + V_{be} \quad (2)$$

where $V'_1$ = the voltage applied to current source 11; and $V_{be}$ = the base-emitter voltage drop of bipolar level shift transistor 28.

In this embodiment, $V_{be}$ is kept less than $V_{TP}$ in order to ensure that transistor 22 remains in the saturation region, thereby keeping transistor 22 operating as a current mode device. If the base-emitter voltage drop of transistor 28 is greater than $V_{TP}$, transistor 22 will cease to be saturated and will operate in the linear region, and therefore not act as a current device. Fortunately, in typical bipolar-CMOS IC fabrication processes, $V_{be}$ is less than $V_{TP}$.

As a feature of this invention, the threshold voltage of transistor 22 and the base-emitter voltage drop of transistor 28 tend to track rather nicely over temperature, assuring that the above constraint that $V_{be}$ be less than $V_{TP}$ will hold over a wide temperature range.

Figure 3:
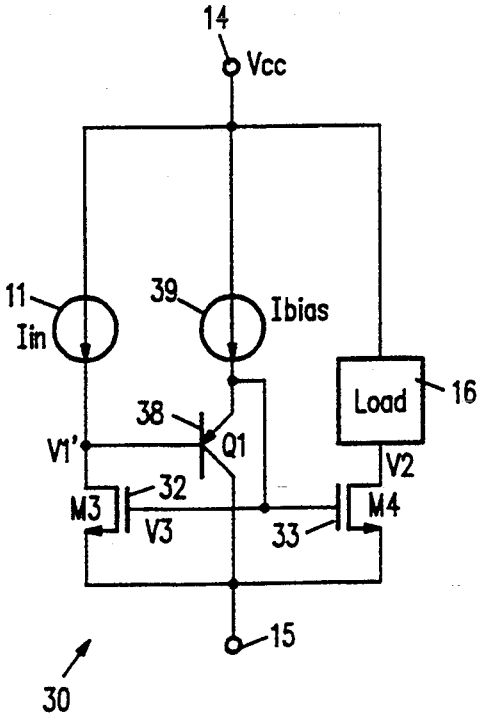
FIG. 3 is a schematic diagram of one embodiment of an N channel MOS current mirror constructed in accordance with the teachings of this invention, which utilizes a bipolar transistor for level shifting.

FIG. 3 is a schematic diagram of another embodiment of a novel current mirror constructed in accordance with the teachings of this invention, utilizing N channel transistors 32 and 33. Current mirror 30 includes $V_{CC}$ supply voltage terminal 14, and supply voltage terminal 15 which is typically connected to ground. Current mirror 30 receives an input current $I_{IN}$ from current source 11 and provides a mirrored and, if desired, ratioed output current to load 16. Input current $I_{IN}$ is applied to the drain of N channel transistor 32, which has its source connected to ground terminal 15. The gates of transistors 32 and 33 are connected in common, the source of transistor 33 is connected to ground terminal 15, and its drain is connected to provide output current to load device 16.

In accordance with the teachings of this invention, bipolar transistor 38 is used to provide an increased voltage across current source 11 as compared with prior art current mirrors. Bipolar transistor 38 has its collector connected to ground terminal 15, its base connected to the drain of transistor 32 and thus to current source 11, and its emitter connected to the commonly connected gates of transistors 32 and 33. A bias current source 39 provides bias current $I_{BIAS}$ through bipolar transistor 38 to ground.

In accordance with the teachings of this invention, novel current mirror 30 provides a voltage to current source 11:

$$V'_1 = (V_{TP} + V_{GO}) - V_{be} \quad (3)$$

where $V'_1$ = the drain-source voltage of transistor 32;

$V_{BE}$ = the base-emitter voltage drop of bipolar level shift transistor 38.

Thus, the voltage appearing across current source 11 is equal to $V_{CC} = V'_1$ which is a greater voltage differential than available in the prior art.

Figure 4:
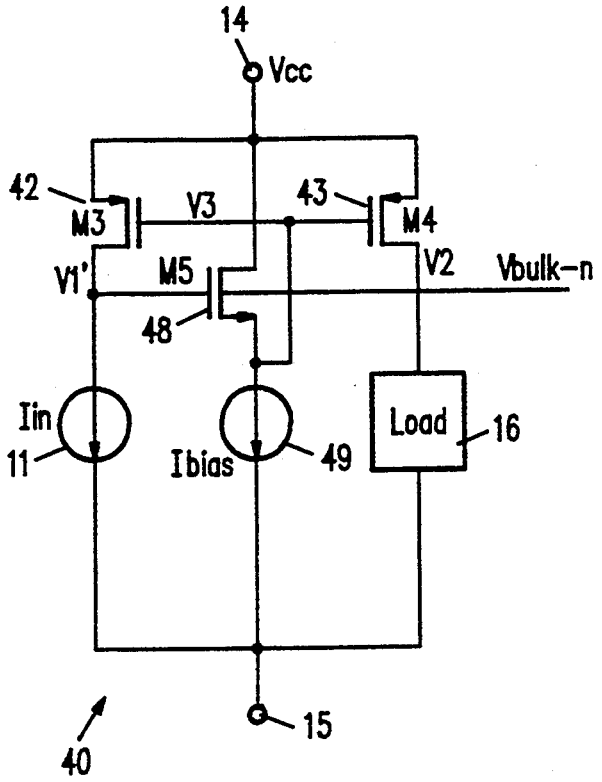
FIG. 4 is a schematic diagram of one embodiment of a P channel MOS current mirror which utilizes an additional MOS device for level shifting.

FIG. 4 is a schematic diagram of one embodiment of a novel current mirror constructed in accordance with the teachings of this invention utilizing P channel current mirror transistors 42 and 43, and N channel level shift transistor 48. Current mirror 40 includes $V_{CC}$ supply voltage terminal 14, and supply voltage terminal 15 which is typically connected to ground. Current mirror 40 receives an input current $I_{IN}$ from current source 11 and provides a mirrored and, if desired, ratioed output current to load 16. Input current $I_{IN}$ is applied to the drain of P channel transistor 42, which has its source connected to $V_{CC}$ terminal 14. The gates of transistors 42 and 43 are connected in common, the source of transistor 43 is connected to $V_{CC}$ terminal 14, and its drain is connected to provide output current to load device 16.

In accordance with the teachings of this invention, N channel level shift transistor 48 is used to provide an increased voltage to current source 11 as compared with prior art current mirrors. Level shift transistor 48 has its drain connected to $V_{CC}$ supply terminal 14 and its source connected to the commonly connected gates of transistors 42 and 43. A bias current source 49 draws bias current $I_{BIAS}$ through level shift transistor 48 to ground. In this embodiment, the bulk of N channel transistor 48 is connected to a bias voltage $V_{BULK-N}$ above its source potential, typically by a few hundred millivolts ( in one embodiment, within the range of approximately 100 to 700 mv). This is in contrast to normal N channel transistor operation in which the bulk is connected to ground. By utilizing bias voltage $V_{BULK-N}$, the gate to source voltage $V_{GS}$ of N channel level shift transistor 48 necessary to turn on transistor 48 is maintained less than the threshold voltage of current mirror transistor 42, thus keeping current mirror transistor 42 in the saturation mode.

In accordance with the teachings of this invention, novel current mirror 40 provides a voltage to current source 11:

$$V'_1 = V_{CC} - (v_{TP} + V_{GO}) + V_{GS} \quad (4)$$

where $V'_1$ = the voltage applied to current source 11; and $V_{GS}$ = the gate-source voltage drop of N channel level shift transistor 48.

Other means may also be used to reduce the gate-source voltage $V_{GS}$ of transistor 48 necessary for the condition $V_{GS,Q48} < V_{TP}$. Such means include threshold adjustment processing step(s) during IC fabrication.

Figure 5:
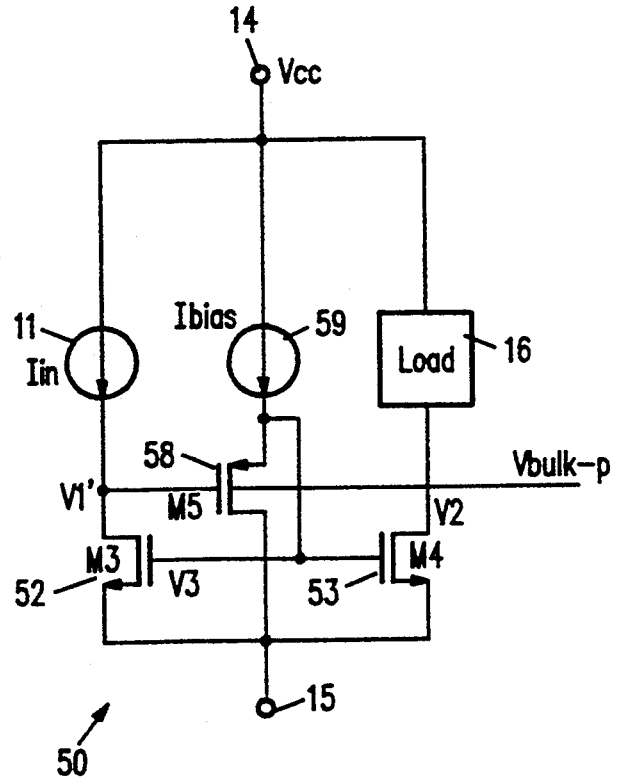
FIG. 5 is a schematic diagram of one embodiment of an N channel MOS current mirror constructed in accordance with the teachings of this invention which utilizes an additional MOS device for level shifting.

FIG. 5 is a schematic diagram of one embodiment of a novel current mirror constructed in accordance with the teachings of this invention utilizing N channel current mirror transistors 52 and 53, and P channel level shift transistor 58. Current mirror 50 includes $V_{CC}$ supply voltage terminal 14, and supply voltage terminal 15 which is typically connected to ground. Current mirror 50 receives an input current $I_{IN}$ from current source 11 and provides a mirrored and, if desired, ratioed output current to load 16. Input current $I_{IN}$ is applied to the drain of N channel transistor 52, which has its source connected to ground terminal 15. The gates of transistors 52 and 53 are connected in common, the source of transistor 53 is connected to ground terminal 15, and its drain is connected to provide output current to load device 16.

In accordance with the teachings of this invention, P channel level shift transistor 58 is used to provide an increased voltage across current source 11 as compared with prior art current mirrors. Level shift transistor 58 has its drain connected to supply terminal 15 and its source connected to the commonly connected gates of transistors 52 and 53. A bias current source 59 supplies bias current $I_{BIAS}$ through level shift transistor 58 to ground. In this embodiment, the bulk of P channel transistor 58 is connected to a bias voltage $V_{BULK-P}$, below $V_{CC}$, typically by a few hundred millivolts below its source potential (in one embodiment, within the range of approximately 100 to 700 mv). This is in contrast to normal P channel transistor operation in which the bulk is connected to $V_{CC}$. By utilizing bias voltage $V_{BULK-N}$, the gate to source voltage of $V_{GS}$ P channel level shift transistor 58 necessary to turn on transistor 58 is maintained less than the threshold voltage of current mirror transistor 52, thus keeping current mirror transistor 52 in the saturation mode.

In accordance with the teachings of this invention, novel current mirror 52 provides a voltage to current source 11:

$$V'_1=(V_{TP}+V_{GO})-V_{GS} \quad (5)$$

where $V'_1$=the drain-source voltage of transistor 52; and $V_{GS}$=the gate-source voltage drop of P channel level shift transistor 58.

Thus, the voltage appearing across current source 11 is equal to $V_{CC}-V'_1$ which is a greater voltage differential than available in the prior art.

Accordingly, a novel current mirror is taught which provides improved input voltage headroom, and which provides for the ratioed current mirroring of an input current supplied by a current source while providing an increased voltage level to that current source as compared with prior art current mirrors. This provides a significant improvement over prior art current mirrors which are likely to provide an insufficiently high voltage level to the current source to allow its proper operation.

The invention now being fully described, it will be apparent to one of ordinary skill in the art that many changes and modifications can be made thereto without departing from the spirit or scope of the appended claims. As but one example, bipolar transistors can be used in place of the MOS mirror transistors shown in the exemplary embodiments of FIGS. 2–5.

What is claimed is:

1. A current mirror comprising:

a first power supply terminal for receiving a first supply voltage;

a second power supply terminal for receiving a second supply voltage;

a first mirror transistor having a first current handling terminal coupled to a first one of said power supply terminals, a second current handling terminal serving as an input terminal for receiving an input current to be mirrored, and a control terminal;

a second mirror transistor having a first current handling terminal coupled to said first one of said power supply terminals, a second current handling terminal serving as an output terminal for providing a mirrored output current as a function of said input current to be mirrored, and a control terminal coupled to said control terminal of said first mirror transistor; and a level shift device comprising a level shift transistor having a first current handling terminal coupled to said first power supply terminal, a second current handling terminal coupled to said commonly coupled control terminals of said first and second mirror transistors, and a control terminal coupled to said input terminal.

2. A current mirror as in claim 1 which further comprises a bias current source coupled to cause current through said level shift transistor.

3. A current mirror as in claim 2 wherein said bias current source is coupled between said second current handling terminal of said level shift transistor and said second power supply terminal.

4. A current mirror as in claim 1 wherein said first and second mirror transistors comprise MOS transistors.

5. A current mirror as in claim 4 wherein said level shift transistor comprises a bipolar transistor.

6. A current mirror as in claim 5 wherein said first and second mirror transistors comprise N channel MOS transistors and said level shift transistor comprises a PNP bipolar transistor.

7. A current mirror as in claim 5 wherein said first and second mirror transistors comprise P channel MOS transistors and said level shift transistor comprises an NPN bipolar transistor.

8. A current mirror as in claim 6 wherein the base-emitter voltage drop of said level shift transistor is less than a threshold voltage of said first mirror transistor.

9. A current mirror as in claim 7 wherein the base-emitter voltage drop of said level shift transistor is less than a threshold voltage of said first mirror transistor.

10. A current mirror as in claim 4 wherein said level shift transistor comprises an MOS transistor.

11. A current mirror as in claim 10 wherein said level shift transistor has its bulk connected to a bias voltage between said first and second supply voltages.

12. A current mirror as in claim 11 wherein said first and second mirror transistors comprise N channel MOS transistors and said level shift transistor comprises a P channel MOS transistor.

13. A current mirror as in claim 12 wherein said first supply voltage is ground and said second supply voltage is a positive voltage.

14. A current mirror as in claim 13 wherein said bias voltage is approximately 100–700 millivolts below the voltage on said second handling terminal of said level shift device.

15. A current mirror as in claim 11 wherein said first and second mirror transistors comprise P channel MOS transistors and said level shift transistor comprises an N channel MOS transistor.

16. A current mirror as in claim 15 wherein said first supply voltage is a positive voltage and said second supply voltage is ground.

17. A current mirror as in claim 16 wherein said bias voltage is approximately 100–700 millivolts above the voltage on said second current handling terminal of said level shifting device.

18. A current mirror comprising:

a first power supply terminal for receiving a first supply voltage;

a second power supply terminal for receiving a second supply voltage;

a first mirror transistor having a first current handling terminal coupled to a first one of said power supply terminals, a second current handling terminal serving as an input terminal for receiving an input current to be mirrored, and a control terminal;

a second mirror transistor having a first current handling terminal coupled to said first one of said power supply terminals, a second current handling terminal serving as an output terminal for providing a mirrored output current as a function of said input current to be mirrored, and a control terminal coupled to said control terminal of said first mirror transistor; and a level shift device comprising a level shift transistor having a first current handling terminal coupled to said first power supply terminal, a second current handling terminal coupled to said commonly coupled control terminals of said first and second mirror transistors, a control terminal coupled to said input terminal, and a bulk region connected to a bias voltage between said first and second supply voltages.

19. A current mirror as in claim 18 wherein said bias voltage provides that the voltage drop between said second current handling terminal of said level shift transistor and said control terminal of said level shift transistor is less than a threshold voltage of said first mirror transistor.

20. A current mirror as in claim 19 which further comprises a bias current source coupled to cause current flow through said level shift transistor.

21. A current mirror as in claim 20 wherein said bias current source is coupled between said second current handling terminal of said level shift transistor and said second power supply terminal.

22. A method for mirroring current comprising the steps of:

providing a first supply voltage;

providing a second supply voltage;

providing a current which is to be mirrored through a first mirror transistor;

providing an output current from a second mirror transistor as a function of said current to be mirrored; and providing a voltage level shift between a control terminal of said first mirror transistor and a current handling terminal of said first mirror transistor for receiving said current to be mirrored, wherein said step of providing a voltage level shift comprises the step of:

applying a bipolar transistor base-emitter voltage drop between said current handling terminal of said first mirror transistor for receiving said current to be mirrored and said control terminal of said first mirror transistor and without causing emitter-collector current of said bipolar transistor to flow through said control terminal of said first mirror transistor.

23. A method as in claim 22 wherein said base-emitter voltage drop is less than a threshold voltage of said first mirror transistor.

24. A method for mirroring current comprising the steps of:

providing a first supply voltage;

providing a second supply voltage;

providing a current which is to be mirrored through a first mirror transistor;

providing an output current from a second mirror transistor as a function of said current to be mirrored; and providing a voltage level shift between a control terminal of said first mirror transistor and a current handling terminal of said first mirror transistor for receiving said current to be mirrored, wherein said step of providing a voltage level shift comprises the step of:

applying an MOS transistor gate-source voltage drop between said current handling terminal of said first mirror transistor for receiving said current to be mirrored and said control terminal of said first mirror transistor and without causing source-drain current of said MOS transistor to flow through said control terminal of said first mirror transistor.

25. A method as in claim 24 wherein said gate-source voltage drop is less than a threshold voltage of said first mirror transistor.

* * * * *